United States Patent [19]

Fahrmbacher-Lutz et al.

[11] Patent Number: 4,525,250

[45] Date of Patent: Jun. 25, 1985

[54] METHOD FOR CHEMICAL REMOVAL OF OXIDE LAYERS FROM OBJECTS OF METAL

[75] Inventors: Ludwig Fahrmbacher-Lutz, Augsburg; Klaus Seidler, Baienfurt, both of Fed. Rep. of Germany

[73] Assignee: Ludwig Fahrmbacher-Lutz, Augsburg, Fed. Rep. of Germany

[21] Appl. No.: 329,115

[22] Filed: Dec. 9, 1981

[30] Foreign Application Priority Data

Dec. 19, 1980 [DE] Fed. Rep. of Germany ..... 3048083

[51] Int. Cl.[3] ..... C25D 5/34; C25F 1/08

[52] U.S. Cl. ..... 204/58.5; 134/41; 156/667; 204/32.1; 204/33; 204/141.5; 252/79.4; 427/309

[58] Field of Search ..... 156/664, 667; 204/141.5, 32 R, 33, 14 N, 58.5; 427/309, 328, 444; 252/79.4, 79.3; 134/41

[56] References Cited

U.S. PATENT DOCUMENTS

| | | | |
|---|---|---|---|
| 3,468,774 | 9/1969 | Kendall | 204/141 |
| 3,562,013 | 2/1971 | Mickelson et al. | 134/3 |
| 4,087,367 | 5/1978 | Rioult et al. | 252/79.1 |
| 4,126,523 | 11/1978 | Wong | 204/32 R |
| 4,314,876 | 2/1982 | Kremer et al. | 156/664 |

OTHER PUBLICATIONS

Metal Finishing Guidebook and Directory for 1978, Metals and Plastics Publications, Inc., Hackensack, N.J., pp. 128–132.

*Primary Examiner*—G. L. Kaplan
*Assistant Examiner*—William T. Leader
*Attorney, Agent, or Firm*—Browdy and Neimark

[57] ABSTRACT

A method for the chemical removal of oxide layers from the surface of objects made of metals, in particular those made of titanium, titanium alloys, nickel, nickel alloys and chrome-nickel steels, so that these objects can subsequently be effectively coated with metals. The removal of the oxide layers is effected in a nonaqueous organic medium containing a mixture of hydrogen fluoride and one or more alkali fluorides and/or ammonium fluoride. By practice of this method, interfering oxide films can be removed from the surfaces of workpieces made of the above-named metals or metal alloys, while maintaining stable dimensional accuracy, prior to a subsequent coating of the workpiece with other metals, in particular metal coating compositions such as aluminum, zinc or silver.

9 Claims, No Drawings

METHOD FOR CHEMICAL REMOVAL OF OXIDE LAYERS FROM OBJECTS OF METAL

FIELD OF THE INVENTION

The invention relates to a method for the chemical removal of oxide layers from objects made of metals, in particular of titanium, titanium alloys, nickel, nickel alloys and chrome-nickel steels, so that the objects can subsequently be coated with metals, especially when the objects are immersed in an organic electrolyte medium.

BACKGROUND OF THE INVENTION

Workpieces of titanium, titanium alloys, nickel, nickel alloys and chrome-nickel steel, in particular, always have an oxide layer on their surface; once it is removed by chemical or mechanical means, the oxide layer forms again spontaneously when the workpiece is exposed to air or is immersed in aqueous media.

As a result of oxide layer formation, a firmly bonded metal coating of the work piece is possible only if these oxide layers are removed before the coating operation is commenced. The subsequent coating step is effected in an organic electrolyte medium in which the workpiece is immersed. These operations including removal of the oxide layer, must be performed under absolutely oxygen- and water-vapor-free conditions in closed apparatuses, which are only exposed to argon or nitrogen gases, for example.

In order to remove oxide layers from workpieces made of the above-named metals or alloys, methods to accomplish this, which are performed in a vacuum are known e.g. where cleaning is effected by means of sputtering (German laid-open application DE-OS No. 28 09 444). A cleaning method using metal melts, which are covered with a fluxing medium, is also known (U.S. Pat. No. 2,992,135). In this latter method, especially when diffusion annealing is performed to attain improved adhesion, there may be an undesirable formation of intermetallic phases, which cause the material to become brittle (G. E. Faulkner and W. J. Lewis, "Recent Development in Ti Brazing", DMIL. Mem. (1960) No. 45, Battell Mem. Inst., Columbus, Ohio; and H. R. Ogden and F. L. Holden, "Metallography of Ti Alloys", TML Report 103, Battell Mem. Inst., Columbus, Ohio). This method is also unsuitable for manufacture of expensive, finally finished workpieces, where strict demands involving dimensional accuracy are made, because dimensional accuracy is adversely affected at the high temperatures of melting. The vacuum methods mentioned above are not only susceptible to failure but are also associated with the disadvantage of requiring very high capital investments.

It is known (E. L. White and P. D. Miller, and R. S. Peoples, "Antigalling Coatings and Lubricants of Ti", TML Report 34, Titanium Metallurgical Laboratory, Battell Institute) that a coating of a titanium substrate with aluminum causes a reduction in tool wear in thermoforming processes and also prevents heavy oxidation of the titanium. It is also known that metallic coatings on titanium surfaces improves the adhesion of lubricants thereto and thus counteracts heavy frictional wear thereof (N. Factica, "Lubrication of Ti", WDL Techn. Report 57-61 II ASTIA Doc. 155564 (1958); de F. G. A. Laat and T. Adams, "Inhibiting the Wear and Galling Characteristics of Ti", Metals Eng. Quarterly 8 (39–48) (1968); D. L. Padberg and J. J. Crosby, "Fretting-Resistant Coatings for Ti Alloys", 2nd International Conference Ti 1972, MIT, Cambridge, Mass. and E. P. Kingsbary and E. Rabinowicz, "Friction and Wear of Metals", Trans. ASME, Paper 58, Lub. 6 (1968)). Coating titanium with silver facilitates practice of a simple hard-soldering process (H. R. Ogden and F. L. Holden, "Metallography of Ti Alloys", TML Report 103, Battell Mem. Inst., Columbus, Ohio). It is further known that zinc layers, which are applied to titanium, serve to protect the substrate against contact corrosion in titanium-combination elements, which are inserted into aluminum (Metalworking Production, Zinc-Plated Titanium 104 (No. 30, P. 9, 1960)).

There is accordingly a frequent need for coating workpieces of metals, in particular those made of titanium, titanium alloys, nickel, nickel alloys, and chrome-nickel steels with a metal, particularly aluminum, zinc or silver. Especially when such coating is practiced using electrolytic means and the above-named metals and metal alloy, coating compositions, the interfering oxide layer must be removed prior to coating, while the dimensional accuracy of the workpieces is precisely adhered to.

SUMMARY OF THE INVENTION

It is accordingly the object of the invention to devise a method by which it is possible to remove the oxide layers from the surfaces of metal workpieces, in particular workpieces made of those metals and alloys named above, in an effective way without impairing the dimensional accuracy and stability of the workpieces and without impairing the physical properties of products made from workpieces, such as screws.

This object is attained by the practice of a process such as described below.

The organic media used in such process are those in which both hydrogen fluoride and alkali fluorides or ammonium fluorides are soluble. Preferably, these media are alcohols, and in particular methanol.

The treatment is preferably effected using a medium containing from 3 to 8% by weight of hydrogen fluoride, 5 to 8% by weight of ammonium fluoride and 5 to 10% by weight of an alkali fluoride, in particular sodium fluoride.

The treatment temperature is preferably between 10° C. and 50° C.

The removal of the oxide layer can preferably be electrochemically performed in accordance with the method of the invention. Specifically, the procedure is such that the workpieces are alternatively switched from an anodic to a cathodic treatment involving the addition of a conducting salt, such as sodium sulfate, and using counterelectrodes, which may be made of titanium or platinum, for example.

Following the removal of the oxide layer, the workpieces are preferably flushed with an inert solvent in an atmosphere free of water vapor and oxygen. This atmosphere is particularly an inert-gas atmosphere which is introduced under conditions free of oxygen and of water vapor, to the apparatus in which the metal coating operation is effected, preferably utilizing electrolytic means. The metal coating compositions are particularly aluminum, copper, nickel and silver; however, germanium beryllium, molybdenum, tungsten and zirconium are also possibilities. In the case of electrolytic deposition, known electrolyte systems may be made use of (U.S. Pat. No. 2,763,605; F. H. Hurley and T. P. Weir, "Electrodeposition of Al from Nonaqueous Solutions", J. Electrochem. Soc. 96, 48–56 (1949); U.S. Pat. Nos. 2,446,331, 2,446,349 and 2,446,350; Elze, Lange, Meyer, "Zur elektrolytischen Abscheidung von Al", Metall 13, 541–549 (1959); Ziegler, Lehmkul, "Zeitschrift anorg. Chem." 283, 414 (1956); R. J. Heritage, "The Electrodeposition of Al", Trans. Inst. Met. Finishing 32, 61–71 (1955); and J. H. Connor, E. E. Reid and Wood, "Electrodeposition of Magnesium and Mg. Alloys", J. Electrochem. Soc. 104, 38/41 (1957)).

DESCRIPTION OF THE PREFERRED EMBODIMENT

The following example illustrates and explains the invention.

A workpiece, made of titanium, is secured to a suitable apparatus which assures both reliable manipulation and secure contact with electric current. The piece is then cleansed of fat residues and any other particles adhering to it using methanol in an atmosphere saturated with oxygen- and water-vapor-free inert gas, such as argon, for example.

Also in an inert gas atmosphere, the workpiece is introduced into a caustic solution comprising by weight 8% hydrogen fluoride, 5% ammonium fluoride and 10% sodium fluoride dissolved in a methanol medium. Disposed in this solution are platinum electrodes which, like the workpiece, are connected to a source of voltage. These electrodes make it possible to change the potential from +10 V to −10 V within one second. During this corroding process, a voltage ratio of the anode to the cathode of 2 to 1 is maintained, at a temperature of 15° C. The direction of the current is reversed every 10 seconds. The described process is terminated after approximately 3 minutes.

The workpiece, now cleansed and freed of any oxide layer it may have had, is subsequently flushed, again with methanol in an atmosphere saturated with an inert gas, and remaining within an inert atmosphere (argon) it is introduced into the electrolyte. In accordance with the disclosures in U.S. Pat. Nos. 2,446,331, 2,446,349 and 2,446,350, the electrolyte is an ethereous solution of 3 Mol aluminum chloride and ca. 1 Mol LiH of Li AlH; using a reversing direct current at a current density of ca. 3 A/Dm$^2$. This electrolyte permits the deposition of smooth, dense aluminum layers of ca. 0.08 cm in thickness while attaining excellent adhesion of the coating to the foundation workpiece material.

What is claimed is:

1. A method for chemical removal of oxide layers from the surface of objects made of titanium or a titanium alloy prior to subsequent coating of said object with a metal characterized in that the oxide removal treatment is carried out with a mixture of hydrogen fluoride and one or more alkali fluorides and/or ammonium fluoride in a non-aqueous organic solution substantially free of water and oxygen molecules.

2. A method according to claim 1 characterized in that the metal object from which the oxide layer has been removed is then flushed with an inert solvent in an atmosphere free of water vapor and oxygen, and is then promptly coated with a metal coating composition before the surface of said metal object can re-oxidize, said metal coating composition comprising a metal selected from the group consisting of aluminum, copper, nickel, silver, germanium, beryllium, molybdenum, tungsten and zirconium.

3. A method for chemical removal of oxide layers from the surface of objects made of metals prior to subsequent coating of said metal object with a metal characterized in that the oxide removal treatment is performed in a nonaqueous organic solution substantially free of water and oxygen molecules, further characterized in that the solution used comprises a nonaqueous alcohol containing dissolved therein from 3 to 8% by weight of hydrogen fluoride, 5 to 8% by weight of ammonium fluoride and 5 to 10% by weight of an alkali fluoride.

4. A method as defined in claim 3 wherein the nonaqueous alcohol is methanol and the alkali fluoride is sodium fluoride.

5. A method as defined by any one of claims 1, 3 or 4 characterized in that the oxide removal treatment is performed at a temperature of from 10° C. to 50° C.

6. A method as defined by claim 5, characterized in that the removal of the oxide layer is carried out by use of electrochemical means and wherein said nonaqueous organic solution serves as the electrolyte.

7. A method as defined by claim 6, characterized in that the electrochemical removal of the oxide layer is performed with the inclusion of alkali salts in the electrolyte solution, in order to increase the conductivity of said electrolyte solution, and including the use of counterelectrodes.

8. A method as defined by claim 7, characterized in that the workpieces, from which the oxide layer has been removed, are flushed with an inert solvent in an atmosphere free of water vapor and oxygen before said workpieces are coated with a metal.

9. A method as defined in claim 3 wherein the metal object is made of a member of the group consisting of titanium, titanium alloys, nickel, nickel alloys and chrome-nickel steels.

* * * * *